United States Patent [19]

Saylors

[11] 4,069,931

[45] Jan. 24, 1978

[54] CAPACITOR REMOVAL DEVICE AND METHOD

[76] Inventor: James P. Saylors, Rte. 1, Pelzer, S.C. 29669

[21] Appl. No.: 728,267

[22] Filed: Sept. 30, 1976

[51] Int. Cl.[2] ..... B65B 69/00

[52] U.S. Cl. ..... 214/310; 156/344; 156/584; 214/1 BA

[58] Field of Search ..... 214/152, 304, 310, 309, 214/1 BA; 198/DIG. 952; 156/344, 584

[56] References Cited

U.S. PATENT DOCUMENTS

| | | | |
|---|---|---|---|
| 3,303,928 | 2/1967 | Meilleur | 214/152 |
| 3,894,633 | 7/1975 | Egan | 156/584 X |
| 3,906,614 | 9/1975 | Rayburn | 214/1 BB |
| 3,970,494 | 7/1976 | Pritchard | 156/344 X |

*Primary Examiner*—Trygve M. Blix
*Assistant Examiner*—George F. Abraham
*Attorney, Agent, or Firm*—Bailey, Dority & Flint

[57] ABSTRACT

A capacitor removal device and method is disclosed for removing capacitors from a holder strip on which the capacitors are secured by an adhesive strip with a body portion of the capacitor extending above the holder strip. The removal device comprises a conveyor carried by a frame for transporting the holder strip with the capacitors carried thereon along a first path, and an elongated guide member carried adjacent a substantial length of the conveyor for engaging the body portion of the capacitor and guiding the capacitor along a second path. The first and second paths diverge relative to each other causing the capacitors to be separated and removed from the holder strip.

11 Claims, 4 Drawing Figures

CAPACITOR REMOVAL DEVICE AND METHOD

BACKGROUND OF THE INVENTION

The invention relates to a device and method for removing manufactured capacitors from a holder strip upon which the finished capacitors are packaged. Normally, the capacitors are secured to the holder strip by an adhesive strip which covers the capacitor wire leads with the capacitor body portion extending above the holder strip. In order for the capacitors to be utilized in the fabrication of electronic circuitry, the capacitors must be removed from the holder strip and the adhesive must be washed from the capacitor wire leads. This removal process is normally done by hand and the adhesive cleaned from the capacitor wire leads by a chemical bath. The presently used chemical bath presents both a hazard to the attendant separating and cleaning the capacitors as well as environmental hazards. This manual process for separating capacitors from the packaged holder strip is both a timely and costly operation.

SUMMARY OF THE INVENTION

A capacitor removal device is provided for removing capacitors from a holder strip on which the capacitors are secured by an adhesive with a body portion of the capacitor extending above the holder strip. The removal device comprises a frame for supporting the device with a conveyor carried by the frame for transporting the holder strip with the capacitors carried thereon along a first path. An elongated guide means is carried by the frame extending adjacent a substantial length of the conveyor means for engaging the body portion of the capacitor and guiding the capacitor along a second path. The first and second paths are divergent relative to each other causing the capacitors guided along the second path to separate from the holder strip transported along the path at a removal zone facilitating removal of the capacitors. A heater element is carried adjacent the conveyor means for heating the holder strip prior to reaching the removal zone causing the adhesive securing the capacitors on the holder strip to be loosened enhancing the removal of the capacitors while reducing the residual adhesive left on the capacitor leads after removal.

Accordingly, an important object of the present invention is to automate the removal of capacitors from a packaging holder strip.

Another important object of the present invention is to provide a capacitor removal device and method for removing capacitors from a packaging holder strip on which the capacitors are secured by an adhesive which eliminates the need for extensive chemical washing of the capacitor wire leads for removing the adhesive.

Still another important object of the present invention is to provide a capacitor removal device which automatically removes capacitors from a packaging holder strip on which the capacitors are carried and conveys the removed capacitors to a chute for delivering the separated capacitors from the conveyor reducing the number of personnel required while affording savings in both time and costs.

Still another important object of the present invention is to provide a capacitor removal device for automatically removing capacitors from a packaging holder strip on which the capacitors are secured by an adhesive strip which eliminates the need for in-plant storage of the hazardous chemicals needed for the washing of the capacitors.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
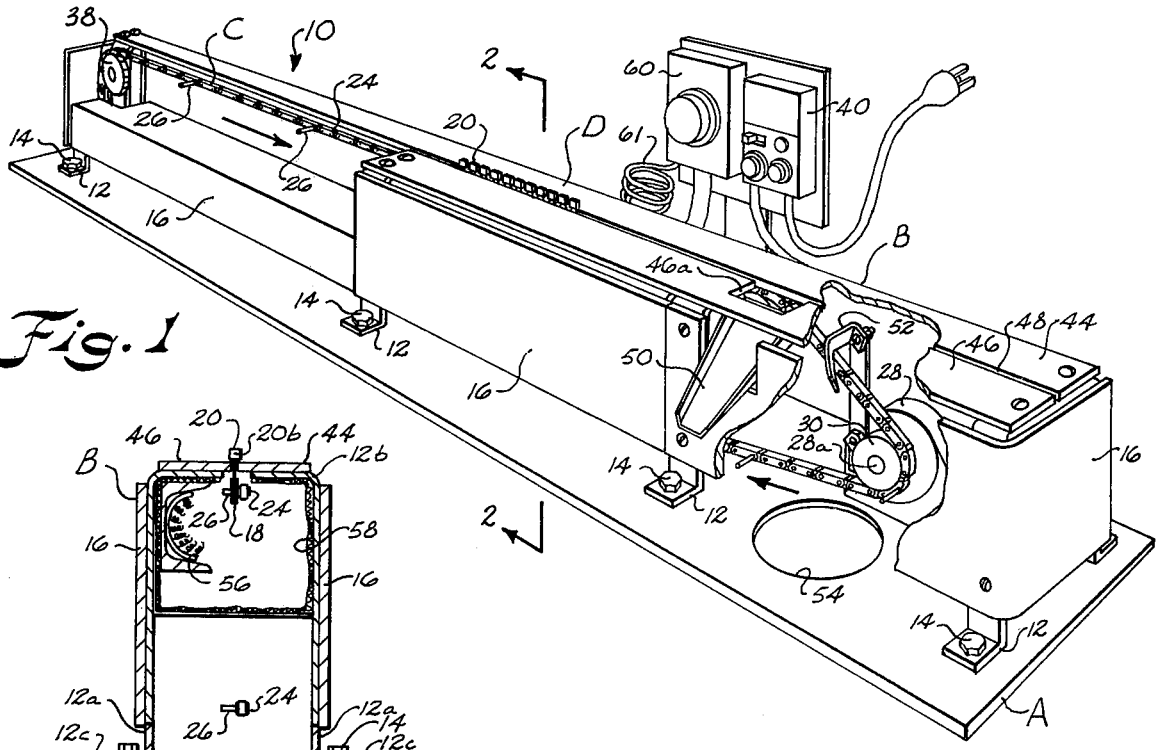
FIG. 1 is a perspective view illustrating a capacitor removal device as constructed in accordance with the present invention.
Figure 2:
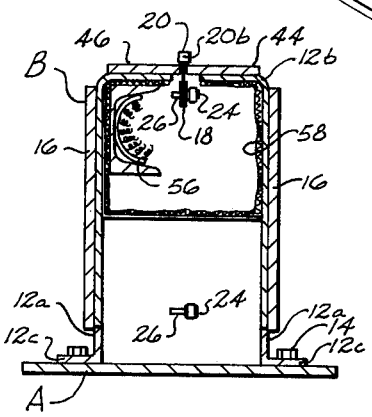
FIG. 2 is a sectional view taken along line 2-2 of FIG. 1.
Figure 3:
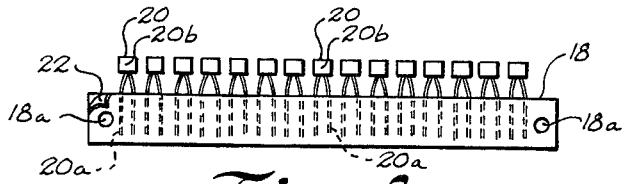
FIG. 3 is a side elevational view illustrating a plurality of capacitors as secured to a packaging holder strip by an adhesive strip.
Figure 4:
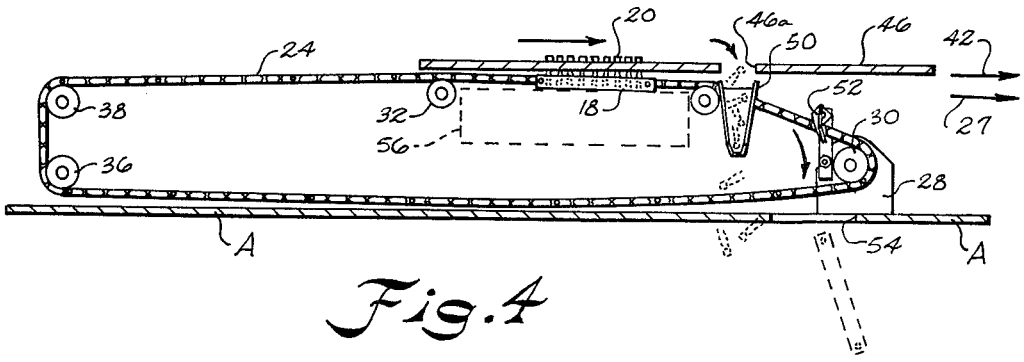
FIG. 4 is a schematic view illustrating the removal of capacitors on a capacitor removal device as constructed in accordance with the present invention.

Referring in more detail to the drawing, a capacitor removal device is illustrated generally at 10 having a base A on which a frame body B is mounted. The frame body B generally supports the elements of the device and includes a plurality of substantially U-shaped frame legs 12 suitably attached to the base A such as by bolts 14. Each frame leg includes upstanding leg portions **12*a* joined by a horizontal flange member 12*b*. Integral with the opposing end of each upright leg 12*a* is a short horizontal mounting flange 12*c* through which the bolt members 14 are secured to the base A. The frame further includes side plate members 16** which enclose and protect the internal parts of the device.

A conveyor means C is carried by the frame for transporting a holder strip 18 on which a plurality of capacitors 20 are secured by an adhesive strip 22 whih covers a portion of the wire leads **20*a* of the capacitor. A body portion 20*b* of the capacitor extends above the holder strip 18. The conveyor means C includes an endless traveling link chain 24 having spaced chain pins 26 providing attachment means for attaching the holder strip 18 to the chain belt 24. The chain pins 26 are preferably extensions of the pins which connect spaced links of chain. In this manner, the spacing distance of the chain pins 26 may be varied as well as additional chain pins added to the link chain as necessary in a convenient manner. The holder strip is secured on the pins 26 by inserting the pins through openings 18*a* formed in the holder strip 18. When transported on the conveyor means C, the holder strip 18 and capacitors carried thereon travel in a first path in the direction of arrow 27**.

A drive means for driving the conveyor chain belt 24 includes an electric motor 28 having a rotating shaft **28*a* on which a sprocket member 30 is affixed for rotation therewith. The chain belt 24 is carried on the sprocket member 30 and is rotated thereby. A member of idler sprocket members 32, 24, 36 and 38 are carried by the frame B and are spaced as needed for supporting the chain member 24. The sprocket members 32, 34, 36 and 38 are rotatably journaled on stationary shafts mounted on the frame B. The idle sprocket members merely rotate as the chain member 24 moves around the sprocket. Suitable controls are provided at 40 for controlling the speed of electric motor 28 and the conveyor chain 24**.

An elongated guide means D is carried by the frame A and extends adjacent a substantial length of the conveyor belt 24 for engaging the body portion 20*b* of the capacitor 20 and guiding each capacitor along a second path having a direction as indicated by arrow 42. The elongated guide means D includes a pair of laterally spaced guide bars 44 and 46 which define a space 48 therebetween through which the lead wires 20*a* of the capacitor 20 depend. The capacitor body portion 20*b* being enlarged relative to the space 40*a* is slidably supported on the top surface of the guide bars 46 and 44 as the lead wires 20*a* are guided and conveyed through the space 48. The guide bars 46 and 44 are preferably carried in a horizontal manner on the frame A while the conveyor chain 24 is adjacently below the guide bars 44 and 46. The conveyor chain is preferably carried by the frame so that the chain belt 24 is inclined downwardly with respect to the horizontal guide bars 44 and 46 as it travels between sprocket members 32 and 34 in the direction of the first path indicated by arrow 27 so that the first and second paths, 27 and 42 diverge. The capacitors 20 will be separated from the holder strip 18 at a capacitor removal zone along the guide bars 44 and 46 at some point where the chain belt 24 and guide bars diverge sufficiently so as to separate completely the capacitors from the holder strip.

The capacitor so separated will depend freely from the guide bars 44 and 46. The free capacitors will hang on the guide bars until subsequently removed capacitors push the freely hanging capacitors to an interruption or opening 46*a* formed in guide bar 46 whereat the capacitors will drop from the guide bars into a chute member 50. The capacitors, released from the guide means, are delivered outwardly through the chute 50 into a receptacle for gathering.

As the empty holder strip 18 is conveyed past the delivery chute 50, it subsequently engages a cam projection element 52 carried by the frame B adjacent the conveyor chain 24. The cam projection member 52 engages the empty holder strip 18 and forces the holder strip 18 off of the chain pins 26 whereby it is removed from the conveyor chain 24 and may fall to waste disposal basket through an opening 54 formed in the base A.

As an expedient to a capacitor removal process, a heating element 56 is carried by the frame B for heating the holder strip 18 prior to reaching the capacitor removal zone causing the adhesive strip 22 securing the capacitors to the holder strip 18 to be loosened. The loosening of the adhesive bond not only enhances the removal of the capacitors but reduces the amount of residual adhesive left on the capacitors after removed whereby the chemical bathing of the capacitors to remove the adhesive may be eliminated. An asbestos material 58 lines the interior of the frame B at the heating zone surrounding the heating element 56 for reducing the loss of heat outwardly therefrom. Of course, other insulation may be provided as needed. A conventional rheostat 60 is provided for controlling the temperature of the heater element 56 having a heat sensing coil 61 located in heat sensing relationship within sides 16 adjacent the heating area of heater 56.

While in the preferred embodiment the guide means D is substantially horizontal and the chain belt 34 moves in a path which is inclined toward the guide bars 44 and 46, it is also possible that the chain belt 24 may be driven in a horizontal path while the guide means D is carried inclined upwardly with respect to as carried on the frame. In other words, what is required is that the two paths be divergent so as to separate the capacitors 20 from the holder stip 18.

Thus, it can be seen that an advantageous construction can be had in accordance with the present invention for automatically separating capacitors from the holder strip on which the capacitors are packaged. By separating the capacitors from the holder strip after the holder strip has passed a heating zone wherein the strip is heated, the adhesive is loosened and it is possible to eliminate the need for extensive chemical washing of the capacitors for removing the adhesive. The large volumes of rather hazardous chemicals heretofore used for removing adhesive from the capacitors will no longer be needed in storage. The capacitor removal device and method of the present invention reduce the number of attendants required for capacitor removal operations affording savings in both time and costs while providing for a safer capacitor removal device and process.

While a preferred embodiment of the invention has been described using specific terms, such description is for illustrative purposes only, and it is to be understood that changes and variations may be made without departing from the spirit or scope of the following claims.

What is claimed is:

1. A capacitor removal device for removing capacitors from a holder strip on which the capacitors are secured with a body portion of the capacitor extending above the holder strip, said removal device comprising:

a frame conveyor means including an endless traveling conveyor member carried by said frame for transporting said holder strip with said capacitors carried thereon along a first path and rotating drive means for driving said conveyor member along a continuous path including said first path;

elongated guide means carried by said frame extending adjacent a substantial length of said conveyor means for engaging said body portion of said capacitors and guiding said capacitors along a second path; and said first and second paths being divergent relative to each other causing said capacitors guided along said second path to separate completely from said holder strip transported along said first path at a removal zone facilitating removal of said capacitors therefrom.

2. The device of claim 1 further comprising heater means carried adjacent said conveyor means for heating said holder strip prior to reaching said removal zone causing an adhesive securing said capacitors on said holder strip to be loosened enhancing the removal of said capacitors while reducing the amount of residual adhesive left on said capacitors after removal.

3. The device of claim 1 wherein said elongated guide means includes a pair of laterally spaced guide bars defining a space therebetween through which lead wires of said capacitor depend with said capacitor body portion being enlarged relative to said space and slideably supported on said guide bars as said lead wires are guided and conveyed through said space.

4. The device of claim 3 wherein said conveyor means is carried by said frame adjacently below said guide bars.

5. The device of claim 1 wherein said guide means is carried in a horizontal manner on said frame and said conveyor means is inclined downwardly relative thereto whereby said first and second paths diverge.

6. The device of claim 1 further comprising chute delivery means carried downstream of said removal zone permitting release and delivery of said separated capacitors from said guide means.

7. The device of claim 6 wherein said chute delivery means includes a slotted interruption in said guide means permitting release of said capacitors therefrom and chute means for delivering said capacitors outwardly from said guide means and device.

8. The device of claim 1 further comprising cam projection means carried adjacent said conveyor means for engaging said holder strip subsequent removal of said capacitors therefrom to remove said holder strip from said conveyor means.

9. The device of claim 1 wherein said conveyor means further includes:

at least one idle member about which said conveyor member moves; and attachment means carried by said conveyor member for attaching said holder strip to said conveyor member.

10. The device of claim 9 wherein said endless conveyor member includes continuous link-chain member and said attachment means includes chain pins extending outwardly from spaced links of said chain.

11. A method for removing capacitors and the like from a holder strip on which the capacitors are secured with a main body portion thereof extending above the holder strip and, comprising the steps of:

providing an endless conveyor member;

rotating said conveyor member about a continuous closed path;

providing attachment means on said conveyor member to which said holder strips may be removably fastened to said conveyor member;

conveying said holder strip on said conveyor member along a first path with such capacitors carried thereon;

providing a pair of elongated flat guide bars having a space defined therebetween;

engaging the body portion of said capacitors and guiding the body portion in a second path divergent to said first path whereby said capacitors are separated completely from said holder strip; and removing said holder strip from said conveyor member.

* * * * *